US007198647B2

(12) United States Patent
Rose et al.

(10) Patent No.: US 7,198,647 B2
(45) Date of Patent: Apr. 3, 2007

(54) PROCESS FOR LIME AND SULFIDE FREE UNHAIRING OF SKINS OR HIDES USING ANIMAL AND/OR PLANT ENZYMES

(75) Inventors: Chellan Rose, Chennai (IN); Lonchin Suguna, Chennai (IN); Raju Rajini, Chennai (IN); Natesan Samivelu, Chennai (IN); Veerapan Rathinasamy, Chennai (IN); Samayavaram Ramalingam, Chennai (IN); Kuttalam Iyappan, Chennai (IN); Thotapalli Parvathaleswara, Chennai (IN); Thirumalaichari Ramasami, Chennai (IN)

(73) Assignee: Council of Scientific and Industrial Research, New Delhi (IN)

( * ) Notice: Subject to any disclaimer, the term of this patent is extended or adjusted under 35 U.S.C. 154(b) by 0 days.

(21) Appl. No.: 10/350,375

(22) Filed: Jan. 23, 2003

(65) Prior Publication Data

US 2004/0006825 A1 Jan. 15, 2004

Related U.S. Application Data

(60) Provisional application No. 60/395,895, filed on Jul. 15, 2002.

(51) Int. Cl.
*C14C 1/06* (2006.01)

(52) U.S. Cl. ..... 8/94.16; 8/94.17; 8/94.18

(58) Field of Classification Search ..... 8/115.51, 8/94.15, 94.16–94.17, 94.18
See application file for complete search history.

(56) References Cited

U.S. PATENT DOCUMENTS

| | | | | |
|---|---|---|---|---|
| 4,273,876 A | | 6/1981 | Monsheimer et al. | 435/265 |
| 4,636,222 A | * | 1/1987 | Pfleiderer et al. | 8/94.16 |
| 5,102,422 A | | 4/1992 | Christner et al. | 8/94.15 |
| 5,525,509 A | | 6/1996 | Christner et al. | 435/265 |

FOREIGN PATENT DOCUMENTS

| | | |
|---|---|---|
| DE | 268873 | 12/1910 |
| WO | 9012118 | 10/1990 |

OTHER PUBLICATIONS

Thanikaivelan et al., "Zero Discharge Tanning: A Shift from Chemical to Biocatalytic Leather Processing", Environ Sci Tech 2002, 36: pp. 4187-4194.

E.Pfleiderer and R.Reiner in Biotechnology, Editor H.J.Rehm, "Microorganisms in Processing of Leather", pp. 729-743, VCH 1988.

K.I. Abraham and P.N. Joshi. "Studies on proteinases from calotropis gigantea latex", Biochimica et Biophysica Acta, 568, 111-126, 1979.

K.A. Walsh, "Trypsinogens and Trypsins of Various Species", Methods in Enzymology, vol. 19, pp. 41-63, 1970.

C.C. Kritzinger, "The chemical and physiological properties of soduim silicofluoride as used in th treatment of hides and skins", J. Soc. Leather Trades Chemists, 36 pp. 217-225, 1952.

A.K. Balls and H. Lineweaver, "Isolation and properties of crystalline papain", Journal of Biological Chemistry, 130, pp. 669-686, 1939.

A.K. Balls, H. Lineweaver and R.R. Thomson, "Crystalline Papain", Science, 86, p. 379, 1937.

* cited by examiner

*Primary Examiner*—Douglas McGinty
*Assistant Examiner*—Preeti Kumar
(74) *Attorney, Agent, or Firm*—Baker Botts LLP

(57) ABSTRACT

The present invention relates to a process for lime- and sulfide-free unhairing of skins/hides using animal and/or herbal (plant) enzymes. The process comprises presoaking the skins or hides in water for 2–6 hours, pasting an enzyme solution of animal or plant origin on the flesh or grain side of the skins/hides and leaving the solution on the skins/hides for 10–24 h at a temperature ranging from 10° C. to 60° C. The soaking liquor is removed and the hides/skins to a bath of water containing 1 to 15% of enzyme for unhairing, with or without intermittent shaking, while maintaining the pH of the bath liquor at 4.5–10.0 for 12–24 h at ambient temperature. The skins/hides are then unhaired for further processing. The total elimination of lime and sulfide in the unhairing process leads to reduced TDS (total dissolved solids), BOD (biological oxygen demand) and COD (chemical oxygen demand) in the effluent without affecting the collagen of the skin/hide or the grain pattern.

23 Claims, No Drawings

PROCESS FOR LIME AND SULFIDE FREE UNHAIRING OF SKINS OR HIDES USING ANIMAL AND/OR PLANT ENZYMES

The present application claims priority to U.S. Provisional application Ser. No. 60/395,895 filed on Jul. 15, 2002, which is incorporated herein by reference in its entirety.

FIELD OF THE INVENTION

The present invention relates to a novel process for total lime and sulfide free unhairing in skins/hides using animal and/or herbal (plant) enzymes. More particularly, the present invention relates to a process of eco-friendly lime and sulfide free unhairing using enzymes of animal and/or herbal origin. The total elimination of lime and sulfide in the unhairing process leads to reduced TDS (total dissolved solids), BOD (Biological oxygen demand) and COD (Chemical oxygen demand) in the effluent without affecting the collagen of the skin/hide or the grain pattern. The TDS, BOD and COD are used as measures of environmental impact of the effluent derived from the tanning process.

This process also helps in the complete recovery of hair. These enzymes can be used in leather processing at pH ranging from 4.0–10.0 without the addition of lime and sulfide or any solid carriers thereby reducing the TDS of the effluent and the pollution thereof.

The aim of unhairing is to remove the hair at its root along with the epidermal layer so that the hair is preserved in its native form. Unlike in the conventional method in which hair itself is attacked and destroyed by the use of calcium hydroxide and sodium sulfide, when it gets contacted with these chemicals, the objective of this process is the enzymatic removal of epidermal layer so that the hair is loosened or removed at its root.

BACKGROUND OF THE INVENTION

Traditionally, lime blended with sodium sulfide is used to remove wool and hair and dissolve these into a pulp. Additionally, this process opens the fiber structure and plumps the hide due to alkalinity. The duration of the process may vary from 18 hours to 7 days depending upon the method employed. This process is responsible for the major parts of the COD load from a tannery due to the chemicals include −2 to 10% lime and 1 to 4% sodium sulfide. The water polluted with these chemicals and the solubilized hair leads to an increase in alkalinity, organic nitrogen, BOD, COD and TDS. There will be air pollution with hydrogen sulfide and the solid wastes with hair pulp, lime and organic matter forming sludge.

Conventionally, lime in combination with sodium sulfide has been used for the unhairing of hides/skins. For hair loosening and opening up, enzymes that remain sufficiently stable in alkaline pH are also used in addition to lime and sulfide. This later method of operation generally takes place in the pH range from 9–12. Both lime and sulfide and its enzyme supported unhairing process result in the discharge of effluent with high TDS (total dissolved solids) and increased pH that pollutes the soil as well as the ground water and therefore cause irreversible damage to the ecosystem.

Since the discovery of the enzymatic unhairing process in 1910 by Otto Rohm (German Patent No. 268-873), considerable amount of work has been carried out and G. H. Green has given a notable review ((J. Soc. Leather Traders Chemists, 36, 217–232, 1952).

The use of proteases in different partial operations in the beam house has been proposed and also realized in practice. [Cf. E. P fleiderer and R. Reiner in Biotechnology, Editor H. J. Rehm, pp. 729–743, VCH 1988]. In addition, amylases, particularly in combination with proteases, have similarly found an entry into bating operation of the beam house (U.S. Pat. No. 4,273,876).

Most of these enzymes used in beam house operation are of microbial origin. Apart from the microbial enzymes, enzymes of animal origin have also been reported (Christner et al, 1992, U.S. Pat. No. 5,102,422) for the purpose of bating.

The concurrent use of lipase and amylases (in the form of pancreatin) in the presence of desoxycholic acid is known from Hungarian patent 33 25 (Chem. Abstr. 77, 7341K).

Monsheimer et al 1981 (U.S. Pat. No. 4,273,876) have disclosed a method for the enzymatic bating of pelts with simultaneous removal of scud in acid pH range in the presence of an amylase and a protease of either microbial or pancreatic origin.

Sorenson et al (WO 90/12118) have disclosed a method for unhairing of skins/hides with an aqueous float with a pH value of 3.5–5.0 and containing an organic acid and a special carbohydrase.

The purification and characterization of proteases from *Calotropis gigantean* have been reported by K. I. Abraham and P. N. Joshi. (Biochimica Biophysica Acta, 568, 111–119, and 120–126, 1979).

The purification and properties of the enzyme from *Carica papaya* have been reported by A. K. Balls, H. Lineweaver and R. R. Thomson (Science, 86, p379, 1937) and A. K. Balls and H. Lineweaver (Journal of Biological Chemistry, 130, p669, 1939).

However, the formulations of these enzymes with suitable treatment to impart stability and storability for the application in industries have not been reported so far. Therefore, to avoid expensive purification processes, the inventors have extracted the crude enzyme and processed it by adding suitable buffer, glycerol and preservative with a view to keep the total activity of the enzyme intact.

The proteolytic enzymes of pancreas have been reported by K. A. Walsh (in Methods in Enzymology, vol 19, 41–63, 1970). The proteolytic enzyme trypsin and its inactive precursor trypsinogen were first obtained in crystalline form from bovine pancreatic tissue by Northrop, J. H., Kunitz, M. and Herriot, R. M. (Crystalline Enzymes, second edition, Columbia University Press, New York, 1948). The inactive trypsinogen is transformed into active trypsin by trypsin itself or by calcium ions.

The cited enzyme formulation of U.S. Pat. No. 5,102,422 contains not only the enzymes of microbial and plant origins and also it has many organic compounds that the applicants have not used in this present invention. The enzyme formulation (U.S. Pat. No. 5,102,422) requires lime for its activity. The distinguished property of enzymes of the present invention is that it does not require lime or sulfide for depilation.

Additionally, enzymes of the present invention, essentially removes the hair along with the epidermal layer which leaves the pelt scud free and white in colour. This provides a process that leaves the hair in an intact form.

The same enzymes of the present invention could also be used in the recovery of value added products from biowastes of leather industry for various applications, for e.g., hydrolysis of chrome shavings and fleshing etc.

In the process of unhairing, both the lime and sulfide and its enzyme supported processes result in the discharge of effluent with high TDS, alkalinity, sulfide, organic nitrogen and ammonia. Besides, these processes are responsible for the major part of BOD and COD load, mainly due to the chemicals that include calcium hydroxide and sodium sulfide.

The inventions thus far reported claim to have enzymes for unhairing in the presence of lime or lime and sulfide system or acids. Secondly, the enzyme solution containing herbal (plant) enzymes in leather processing have not been reported so far.

The enzyme preparations containing pancreatic enzymes have been reported to be useful only for bating and degreasing. Several organic solvents have been reportedly used in the enzyme preparation. These may have adverse effects on the public health and environment particularly at the application level. Moreover, the enzymes that depend mostly on structural organizations for their activity have the tendency of denaturation by organic solvents like any other proteins.

The purification and characterization of proteases from *Calotropis gigantea* have been reported by K. I. Abraham and P. N. Joshi (Biochimica et Biophysica Acta, 568, 111–119, 120–126, 1979). The purification and properties of the enzymes isolated from *Carica papaya* have been reported by A. K. Balls and H. Lineweaver (Journal of Biological Chemistry, 130, p 669, 1939). However, the formulations of these enzymes with suitable treatment to impart stability and storability for the application in industries have not been reported so far. Therefore, to avoid the expensive purification processes, the applicants have extracted the crude enzyme and processed it by adding suitable buffer, glycerol and preservative with a view to keep the total activity of the enzyme intact.

The proteolytic enzymes of pancreas have been reported by K. A. Walsh (in Methods in Enzymology, vol 19, 41–63, 1970). The proteolytic enzyme trypsin and its inactive precursor, trypsinogen were first obtained in crystalline form from bovine pancreatic tissue by Northrop, J. H., Kunitz, M and Herriot R. M. (Crystalline Enzymes, second edition, Columbia University Press, New York, 1948). The inactive trypsinogen is transformed into active trypsin by trypsin itself or by calcium ions.

Use of many chemicals and solvents in the prior art products (U.S. Pat. Nos. 5,102,422 and 5,525,509) may lead to a number of leather imperfections. The methods followed are also cumbersome and cost defective due to power and water consumption.

The enzyme carriers, such as Bentonite and kaolines, used in the prior art products at the unhairing stage further contribute to increase the TDS of the effluent.

However, no animal enzymes have been reported so far for unhairing in the absence of lime and/or lime and sulfide system or acids. Additionally, the enzymatic unhairing and bating occurring in a single step has also not been reported yet.

The main objective of the present invention is to provide a novel process for total lime—sulfide free unhairing in skins/hides using animal and/or herbal (plant) enzymes to solve the problems caused by lime or lime and sulfide or lime and sulfide aided enzymatic method of leather processing.

Another objective of the present invention is to minimize/avoid water and power consumption and reduces the effluent volume drastically.

Yet another objective of the present invention is to use an enzyme solution for beam house operation that is stable even up to 60° C. for at least 6 weeks without losing its activity.

Still another objective of this invention is to use an enzyme solution that is economically and ecologically acceptable for use in leather processing.

Still yet another objective of this invention is to evolve an enzymatic process wherein both lime, lime and sulfide free unhairing and bating taking place simultaneously.

Yet another objective of this invention is to recover the whole hair in its native state as it appears on the animal for its further utilization and to reduce the BOD and COD levels of the effluent discharged.

Still yet another objective of this invention is to remove the hair along with the epidermal layer to obtain scud free white pelt, which is uncommon in other enzymatic or non-enzymatic methods of unhairing.

SUMMARY OF THE INVENTION

The present invention provides a process for lime and sulfide free unhairing of skins/hides using animal and/or herbal (plant) enzymes, said process comprising preparing an enzyme solution from an animal and/or herbal sources, application of the said enzyme either by pasting or by spraying on the flesh side of the presoaked or raw skin/hides in the absence of lime or lime and sulfide, piling of the skins/hides flesh to flesh or grain to grain, floating of the presoaked or raw skins/hides in water containing enzyme solution, and unhairing of the skins/hides either by scraping the hair with a curved knife on a wooden beam or by an unhairing machine.

DETAILED DESCRIPTION OF THE INVENTION

The present invention provides a process for total lime and sulfide free unhairing in skins/hides using animal and/or herbal enzymes, said process comprising steps of: preparing an enzyme solution selected from animal and/or plant source(s), presoaking of the skins/hides in about 300% wt/vol. of water at 10° C. to 60° C. for 2 to 6 hours, removing the soaking liquor and applying the said enzyme either by pasting or spraying on the flesh side of the presoaked or raw skin or hide and left for 10–24 hours at a temperature ranging between 10° C. to 60° C., piling of the skins or hides of the step (iii) by stacking the skins/hides one over the other by keeping the flesh side to the flesh side or grain side to grain side together, floating the presoaked or raw skins or hides in water containing enzyme solution, and unhairing of the skins or hides either by scraping the hair with a curved knife on a wooden beam or by an unhairing machine.

In an embodiment of the invention relates to a process, concentration of the protein in the enzyme solution is in the range of 1 to 6 per cent by weight.

In another embodiment, the concentration of the enzyme solution used is in the range of 1 to 20% wt/wt, preferably about 1 to 6% by weight In another embodiment of the invention, the animal enzyme is obtained from group of animal tissues selected from the group consisting of hypochondrial organs, epigastric organs, peritoneal organs, stomach, duodenum, pancreas, liver, the whole intestine or the visceral organs of animals selected from group consisting of buffalo, cattle, goat and sheep.

In another embodiment, the herbal enzyme is obtained from the plant tissues selected from the group consisting of *Euphorbia antiquorum, Carica papaya, Plumeria alba, Calotropis gigantea* and *Euphorbia nerrifolia.*

In another embodiment, the animal tissues express hydrolytic activity of protein, as determined by casein digestion method (expressed in Kunitz Units).

One more embodiment of the invention relates to a process wherein the plant tissues expressing the hydrolytic activity of proteins used may be such as the young root, bark, stem, leaves, unripe fruits, exudates or the whole plant of *Carica, Euphorbia, Calotropis* and *Plumeria*, wherein such activity of enzyme has not been reported so far.

Still another embodiment, the application of said enzyme is carried out either by pasting or by spraying on the flesh side or on the grain side of the presoaked or raw skin/hide, in the absence or lime or lime and sulfide.

In another embodiment, the piling of skins/hides is carried out flesh to flesh or grain to grain and are stored at a temperature ranging from 10° to 60° C. for 12 to 24 hours.

In another embodiment, the unhairing is carried out either by scraping the hair with a curved knife on a wooden beam or by an unhairing machine.

In another embodiment, floating of the presoaked or raw skins/hides is carried out in 50–300% water containing 1–15% enzyme to the weight of the skins/hides and leaving for 3 to 24 hr at ambient temperature with or without intermittent handling or shaking or tumbling. The pH of the float liquor should not exceed 10.0.

Still another embodiment, the unhairing of the skins/hides is carried out either by scraping the hair with a curved knife on a wooden beam or by an unhairing machine.

Enzymes of animal origin are trypsin (EC 3.4.21.4), chymotrypsin (EC 3.4.21.1), carboxypeptidase A (EC 3.4.17.1), metallocarboxypeptidase, carboxypeptidase B (EC 3.4.17.2), alpha-amylase (EC 3.2.1.1), alpha 1,4, D glucosidase and lipase (3.1.1.3) triglycerol lipase.

Enzymes of plant origin include papain (EC 3.4.22.2), calotropin, cucumisin-like protease found in *Euphorbia* and *Plumeria.*

In an embodiment of the present invention, the enzyme solution prepared from animal or plant tissue used for unhairing the hides/skins requires no lime and/or sulfide for its function.

In yet another embodiment of the present invention, the application of the said enzyme either by pasting or by spraying on the flesh side or on the grain side of the presoaked or raw skin/hide in the absence of lime or lime or sulfide In still yet another embodiment of the present invention, the unhairing of the skins/hides either by scraping the hair with a curved knife on a wooden beam or by an unhairing machine after 12–24 hrs.

In yet another embodiment, BOD of the effluent is reduced by about 65.54% compared to lime and sulfide used in conventional dehairing process.

In yet another embodiment, COD of the effluent is reduced to about 35.85% compared to lime and sulfide used conventional dehairing process.

In yet another embodiment, TDS of the effluent is reduced to about 42.63% compared to lime and sulfide used conventional dehairing process.

In yet another embodiment, collagen of the skin or hides or grain pattern of the skin/hide is maintained.

In yet another embodiment, the said method facilitates removal of epidermal layer by loosening or removing at its root to obtain scud free white pelt.

In yet another embodiment, the enzymatic unhairing and bating occurs in a single step.

The process of the present invention is described below in detail.

The hides/skins were presoaked in 300 percent water at 10° C. to 40° C. for 2–6 hours, and then the soaking liquor was removed. 1–15% of the enzyme solution was pasted on the flesh or grain side of the skins/hides and left for 10–24 h at a temperature ranging from 10° C. to 60° C. or the hides/skins are presoaked in 300 percent water at ambient temperature for 4 hours, and then the soaking liquor was removed and the hides/skins were transferred to a bath of 300 percent water containing 15% of enzyme for unhairing with or without intermittent shaking. The pH of the bath liquor was kept at 4.5–10.0. The skins/hides were left in this bath for 12–24 h at ambient temperature and then unhaired for further processing.

The source of the tissues from which the enzymes extracted is selected from buffalo, cattle, goat and sheep.

The tissues used for extraction are selected from stomach, duodenum, pancreas, liver, the whole intestine or visceral organs. The tissues used for extraction from plant source are young root, bark, stem, leaves, unripe fruits, exudates or the whole plant of *Carica* or *Euphorbia* or *Calotropis* or *Plumeria.*

The novelty and non-obviousness of the present invention is the total elimination of lime or lime and sulfide for unhairing process. So far, no report on the enzymatic unhairing and bating carried out in a single step using animal and/or plant enzymes is available. Moreover the enzyme works at a pH, which does not require any harmful acid or alkali for its activity and therefore curtails the consumption of hazardous chemicals. Additionally, the enzymatic beam house operation facilitates the removal of hair from hide/skin along with the basal layer of epidermis that leaves the pelt white, scud free and undamaged grain ready for tanning that has never been reported so far in any invention or report.

EXAMPLES

The following examples are given by way of illustration of the present invention and therefore should not be construed to limit the scope of the present invention.

Example 1

Plant Enzyme Preparation from Exudates: The crude enzyme preparation was carried out by collecting the exudates over 0.2M phosphate buffer, pH 7.5, containing glycerol. The final volume of the exudate, buffer and the glycerol in the enzyme preparation was in the ratio of 2:2:1. This was stirred by using a stirrer for 30 minutes to 1 hour at room temperature to obtain homogenous solution. This enzyme preparation was filtered through a bed of glass wool and the activity of the enzyme found to be 60–80 U/ml (by Kunitz). This crude enzyme preparation was used for unhairing process.

Enzyme from Plant Parts: The fresh part of the plant (any part), after a preliminary wash with clean water, was homogenized thoroughly with equal part by weight of 0.01M phosphate buffer, pH 7.8, containing 2% sodium meta bisulphite (w/v) which served as preservative. 15% (w/w) of this enzyme preparation was applied on the flesh side of the skin/hide and left for 20 hours at room temperature for unhairing.

Preparation of Enzyme from Animal Source: The animal organ(s) after cleaning free of blood and fat, was rinsed once with clean water, homogenized thoroughly with equal volume of 0.1M sodium bicarbonate, pH 8.0 to 9.0 containing 0.2M calcium chloride. Sodium meta bisulfite, 2% (w/w), was then added as preservative and mixed thoroughly. This homogenate was then filtered through nylon mesh and the activity of this crude enzyme solution was found to be 100–150 U/ml solution (by Kunitz).

Example 1A for Raw Skin/Hide

10% of the enzyme solution prepared from the exudates of Calotropis was applied by pasting on the flesh side of the raw skin and piled flesh to flesh, left for overnight at room temperature and then unhaired for further process.

Example 1B for Raw Skin/Hide 7.5% of the enzyme solution prepared from pancreas was applied by pasting on the flesh side of the raw skin and piled flesh to flesh, left for overnight at room temperature and then unhaired for further process.

Example 1C for Raw Skin/Hide

8% of the enzyme solution prepared from the exudate of *Euphorbia antiquorum* was applied by pasting on the grain side of the raw skin and piled flesh side to flesh side, left for overnight at room temperature and then unhaired for further process.

Example 1D for Raw Skin/Hide

10% of the enzyme solution prepared from the pancreas was used for unhairing. The hides/skins are presoaked in 300 percent water at ambient temperature for 4 hours, and then the soaking liquor was removed. Followed by this, the hides/skins were transferred to a bath of 300 percent water containing 10% of enzyme for unhairing with intermittent shaking. The pH of the bath liquor was kept at 8.5. The skins/hides were left in this bath overnight and then unhaired for tanning.

Example 2

12% of the enzyme solution prepared from the mucosa of peritoneal organs was applied by painting on the flesh side of the presoaked hide and piled grain to grain and left overnight at room temperature and then unhaired for further process.

Example 3

The enzyme solution containing the extract from the mucosa of peritoneal organ was used for beam house operation of leather making. The hides/skins are presoaked in 300 percent by weight of water at ambient temperature for 4 hours, and then the soaking liquor was removed. Followed by this, the hides/skins were transferred to a bath of 300 percent water containing 15% of enzyme for unhairing with intermittent shaking. The pH of the bath liquor was kept at 4.5. The skins/hides were left in this bath overnight and then unhaired for tanning.

Example 4

15% of the enzyme solution prepared from the whole peritoneal organ was applied on the flesh side of the skins after presoaking which had soaking enzyme in the bath. The skins were kept for 20 h at ambient temperature and unhaired for further processing.

Example 5

10% of the enzyme solution prepared from the hepatopancreas was applied by painting on the grain side of the presoaked hide and piled grain to grain and left overnight at room temperature and then unhaired for further process.

Example 6

10% of the enzyme solution prepared from the hepatopancreas was applied by painting on the flesh side of the presoaked hide and piled flesh to flesh and left overnight at room temperature and then unhaired for further process.

Example 7

12% of the enzyme solution prepared from the organs of epigastric region was used for unhairing. The hides/skins are presoaked in 300 percent water at ambient temperature for 4 hours, and then the soaking liquor was removed. Followed by this, the hides/skins were transferred to a bath of 300 percent water containing 12% of enzyme for unhairing with intermittent shaking. The pH of the bath liquor was kept at 7.5. The skins/hides were left in this bath overnight and then unhaired for tanning.

Example 8

10% of the enzyme solution prepared from the pancreas was used for unhairing. The hides/skins are presoaked in 300 percent water at ambient temperature for 4 hours, and then the soaking liquor was removed. Followed by this, the hides/skins were transferred to a bath of 300 percent water containing 10% of enzyme for unhairing with intermittent shaking. The pH of the bath liquor was kept at 7.0. The skins/hides were left in this bath overnight and then unhaired for tanning.

Example 9

10% of the enzyme solution prepared from the pancreas was applied by painting on the flesh side of the presoaked hide and piled flesh to flesh and left overnight at room temperature and then unhaired for further process.

Example 10

10% of the enzyme solution prepared from the pancreas was applied by painting on the grain side of the presoaked hide and piled grain to grain and left overnight at room temperature and then unhaired for further process.

Example 11

The enzyme solution containing the extract from the green parts of the plant tissue of *Euphorbia antiquorum* was used for beam house operation of leather making. The hides/skins are presoaked in 300 percent by weight of water at ambient temperature for 4 hours, and then the soaking liquor was removed. Followed by this, the hides/skins were transferred to a bath of 300 percent water containing 15% of enzyme for unhairing with intermittent shaking. The pH of the bath liquor was kept at 4.5. The skins/hides were left in this bath overnight and then unhaired for tanning.

Example 12

10% of the enzyme solution prepared from the unripe fruit of *Carica papaya* was applied on the flesh side of the skins after presoaking which had soaking enzyme in the bath. The skins were kept for 20 h at ambient temperature and unhaired for further processing.

Example 13

15% of the enzyme solution prepared from the exudates of the *Calotropis* was applied by painting on the grain side of the presoaked hide and piled grain to grain and left overnight at room temperature and then unhaired for further process.

Example 14

15% of the enzyme solution prepared from the exudates of the *Calotropis* was applied by painting on the flesh side of the presoaked hide and piled grain to grain and left overnight at room temperature and then unhaired for further process.

Example 15

15% of the enzyme solution prepared from the exudates of *Calotropis* was used for unhairing. The hides/skins are presoaked in 300 percent water at ambient temperature for 4 hours, and then the soaking liquor was removed. Followed by this, the hides/skins were transferred to a bath of 300 percent water containing 15% of enzyme for unhairing with intermittent shaking. The pH of the bath liquor was kept at 5.5. The skins/hides were left in this bath overnight and then unhaired for tanning.

Example 16

15% of the enzyme solution prepared from the exudates of *Calotropis* was used for unhairing. The hides/skins were presoaked in 300 percent water at ambient temperature for 4 hours, and then the soaking liquor was removed. Followed by this, the hides/skins were transferred to a bath of 100 percent water containing 15% of enzyme for unhairing with intermittent shaking. The pH of the bath liquor was kept at 7.5. The skins/hides were left in this bath overnight and then unhaired for tanning.

Example 17

The enzyme solution prepared from the exudates *Carica* was used for unhairing. The hides/skins were presoaked in 300 percent of water at ambient temperature for 4 hours, and then the soaking liquor was removed. Followed by this, the hides/skins were transferred to a bath of 300 percent water containing 15% of enzyme solution for unhairing with intermittent shaking. The pH of the bath liquor was kept at 4.5. The skins/hides were left in this bath overnight and then unhaired for tanning.

Example 18

15% of the enzyme solution prepared from the exudates of the *Carica* was applied by painting on the flesh side of the presoaked hide and piled grain to grain and left overnight at room temperature and then unhaired for further process.

Example 19

The enzyme solution containing the extract from the green parts of the plant tissue of Calotropis was used for beam house operation of leather making. The hides/skins were presoaked in 300 percent by weight of water at ambient temperature for 4 hours, and then the soaking liquor was removed. Followed by this, the hides/skins were transferred to a bath of 300 percent water containing 15% of enzyme for unhairing with intermittent shaking. The pH of the bath liquor was kept at 7.0. The skins/hides were left in this bath overnight and then unhaired for tanning.

Example 20

15% of the enzyme solution prepared from the exudates of *Euphorbia antiquorum* was applied by painting on the flesh side of the presoaked hide and piled grain to grain and left overnight at room temperature and then unhaired for further process.

Example 21

15% of the enzyme solution prepared from the green parts of the *Calotropis* was applied by painting on the flesh side of the presoaked hide and piled grain to grain and left overnight at room temperature and then unhaired for further process.

Example 22

15% of the enzyme solution prepared from the exudates of *Euphorbia tirucalli* was applied by painting on the flesh side of the presoaked hide and piled grain to grain and left overnight at room temperature and then unhaired for further process.

Example 23

One part of the enzyme from the latex of *Calotropis* and two parts of enzyme from pancreas were mixed thoroughly and 0.1% Ampicillin was added in the enzyme mixture. 7.5% (v/w) of this mixture was applied on the flesh side of the presoaked skin/hide and left overnight. The skin/hide was unhaired for further processing.

Example 24

One part of the enzyme from the latex of *Calotropis* and one part of enzyme from pancreas were mixed thoroughly and 0.1% tetracyclin was added in the enzyme mixture. 7.5% (v/w) of this mixture was applied on the flesh side of the presoaked skin/hide and left overnight. The skin/hide was unhaired for further processing.

Example 25

One part of the enzyme from the latex of *Calotropis* and one part of enzyme from pancreas were mixed thoroughly and 0.1% tetracycline and 1% sodium meta bisulfite were added in the enzyme mixture. 7.5% (v/w) of this mixture was applied on the flesh side of the presoaked skin/hide and left overnight. The skin/hide was unhaired for further processing.

Example 26

One part of the enzyme from the latex of *Calotropis* and one part of enzyme from pancreas were mixed thoroughly and 0.3% sodium chlorite was added in the enzyme mixture. 7.5% (v/w) of this mixture was applied on the flesh side of the presoaked skin/hide and left overnight. The skin/hide was unhaired for further processing.

Example 27 (for Raw Skin/Hide)

10% of the enzyme solution prepared from the exudate of *calotropis* was applied by pasting on the flesh side of the raw skin and piled flesh to flesh and left overnight at room temperature and then unhaired for further process.

7.5% of the enzyme solution prepared from the pancreas was applied by pasting on the flesh side of the raw skin and piled flesh to flesh and left overnight at room temperature and then unhaired for further process.

8% of the enzyme solution prepared from the exudate of *Euphorbia antiquorum* was applied by pasting on the grain side of the raw hide and piled flesh to flesh and left overnight at room temperature and then unhaired for further process.

10% of the enzyme solution prepared from the pancreas was used for unhairing. The hides/skins were presoaked in 300 percent water at ambient temperature for 4 hours, and then the soaking liquor was removed. Followed by this, the hides/skins were transferred to a bath of 300 percent water containing 10% of enzyme for unhairing with intermittent shaking. The pH of the bath liquor was kept at 8.5. The skins/hides were left in this bath overnight and then unhaired for tanning.

A 65.54% reduction in BOD was observed in comparison to the conventional method. In the conventional method, the total BOD is 37 kg/ton whereas in our enzymatic method it is only 12.75 kg/ton. The COD is reduced to 35.84% and TDS to 42.63% when compared to the conventional method.

The most important advantage is that the process does not require any lime or sulfide or the chemicals of such kind for its functionality. In other words, it is a total lime and sulfide free enzymatic method of unhairing.

The leather process in the beam house operation involving the inventive enzymes optionally minimizes the consumption of water and power.

The exciting benefit of this process of unhairing is the removal of hair from the skin along with the basal layer of epidermis and therefore facilitates the easy collection of hair or wool and thereby prevents the formation of biosludge.

Yet another advantage of this process is its eco-friendly nature, because the pulping of hair as occurs in the conventional process that is responsible for the increased BOD and TDS, is totally eliminated.

Yet another advantage of this process of unhairing is the reduction in the COD level compared to the conventional method.

Still another advantage of this inventive enzymatic unhairing process is the total prevention of the chemical sludge formation.

Still another advantage of this inventive enzymatic unhairing process is the minimal handling loss.

Still yet another advantage of this process of unhairing is, obtaining a scud free white pelt, which may help in improving the color brilliance of the leather in the post tanning operation.

Still yet another advantage of this enzymatic unhairing process is the increase in the area of the unhaired skin.

We claim:

1. A method for unhairing animal skins or hides each having a flesh side and a grain side consisting the steps of:

preparing a chemical-free enzymatic solution having no lime or sulfides therein from animal or plant tissue, presoaking the skins or hides in water at 10° C. to 60° C. for 2 to 6 hours, removing the water after the presoaking step, applying the enzymatic solution to the skins or hides by pasting or spraying the flesh side of the skins or hides, incubating the skins or hides at a temperature of 10° C. to 60° C. for 10 to 24 hours, wherein the skins or hides are arranged flesh side to flesh side or grain side to grain side, floating the skins or hides in liquid comprising the enzymatic solution, removing the skins or hides from the liquid comprising the enzymatic solution to produce an effluent and preparing the skins or hides for tanning by scraping the skins or hides with a curved knife on a wooden beam or using an unhairing machine to substantially completely unhair said skins or hides.

2. The method of claim 1, wherein the animal skins or hides are selected from the group consisting of the skins or hides of buffalo, cattle, goat and sheep.

3. The method of claim 1, wherein the enzymatic solution is prepared from an animal tissue selected from the group consisting hypochondrial organs, epigastric organs, peritoneal organs, stomach, duodenum, pancreas, liver, the whole intestine and visceral organs.

4. The method of claim 3, wherein the enzymatic solution comprises enzymes selected from the group consisting of trypsin (EC 3.4.21.4), chymotrypsin (EC 3.4.21.1), carboxypeptidase A (EC 3.4.17.1), metallocarboxypeptidase, carboxypeptidase B (EC 3.4.17.2), alpha-amylase (EC 3.2.1.1), alpha 1,4, D glucosidase and lipase (3.1.1.3) triglycerol lipase.

5. The method of claim 1, wherein the enzymatic solution is prepared from a plant selected from the group consisting of *Euphorbia antiquorum, Carica papaya, Plumeria alba, Calotropis gigantea* and *Buphorbia nerrifolia.*

6. The method of claim 1, wherein the enzymatic solution is prepared from plant tissue selected from the group consisting of young root, bark, stem, leaves, unripe fruits, exudates and the whole plant.

7. The method of claim 6, wherein the enzymatic solution comprises enzymes selected from the group consisting of papain (3.4.22.2), calotropin and cucumisin-like protease found in *Euphorbia.*

8. The method of claim 1, wherein the enzymatic solution comprises 1–20% of enzyme by weight.

9. The method of claim 1, wherein the enzymatic solution comprises 1 to 6% of enzyme by weight.

10. The method of claim 1, wherein the enzymatic solution comprises 1–6% of protein by weight.

11. The method of claim 1, wherein the skins or hides are soaked in about 300% by weight of water.

12. The method of claim 1, wherein the skin or hides used is either raw skin or hide or presoaked skin or hide.

13. The method of claim 1, wherein the enzymatic solution is in the range of 1–15% by weight of enzyme to the weight of the hides or skins.

14. The method of claim 1, wherein the effluent exhibits a reduced biological oxygen demand (BOD) in comparison to effluent derived from conventional dehairing processes.

15. The method of claim 14, wherein the BOD is reduced by about 65.54%.

16. The method of claim 15, wherein the BOD is less than 37 kg/ton.

17. The method of claim 1, wherein the effluent exhibits a reduced chemical oxygen demand (COD) in comparison to effluent derived from conventional dehairing processes.

18. The method of claim 17, wherein the COD is reduced by about 35.85%.

19. The method of claim 1, wherein the effluent exhibits a reduced total dissolved solids (TDS) in comparison to effluent derived from conventional dehairing processes.

20. The method of claim 19, wherein the TDS is reduced to about 42.63%.

21. The method of claim 1, wherein the skin or hide retains collagen to maintain grain pattern of skin or hide.

22. The method of claim 1, wherein unhairing occurs at the epidermal layer by loosening or removing at hair roots to obtain scud free white pelt.

23. The method of claim 1, wherein incubating the skins or hides functions in bating the skins or hides without an additional step.

* * * * *